US009339848B2

(12) United States Patent
Berkhout et al.

(10) Patent No.: US 9,339,848 B2
(45) Date of Patent: May 17, 2016

(54) SEPARATION APPARATUS

(71) Applicant: Inashco R&D B. V., Delft (NL)

(72) Inventors: Simon Peter Maria Berkhout, Delft (NL); Peter Carlo Rem, Rijswijk (NL)

(73) Assignee: ADR TECHNOLOGY B.V., Rotterdam (NL)

( * ) Notice: Subject to any disclaimer, the term of this patent is extended or adjusted under 35 U.S.C. 154(b) by 0 days.

(21) Appl. No.: 14/696,230

(22) Filed: Apr. 24, 2015

(65) Prior Publication Data

US 2015/0273529 A1 Oct. 1, 2015

Related U.S. Application Data

(63) Continuation of application No. 13/812,222, filed as application No. PCT/NL2011/050515 on Jul. 15, 2011, now Pat. No. 9,033,157.

(30) Foreign Application Priority Data

Jul. 28, 2010 (EP) ..... 10171151

(51) Int. Cl.
*B07C 5/00* (2006.01)
*B07B 15/00* (2006.01)
(Continued)

(52) U.S. Cl.
CPC . *B07B 15/00* (2013.01); *B07B 4/00* (2013.01); *B07B 13/10* (2013.01); *B07B 13/116* (2013.01); *B07B 13/16* (2013.01)

(58) Field of Classification Search
CPC ..... B07C 5/00; B07C 5/34; B07B 15/00; B07B 13/13
USPC ..... 209/644
See application file for complete search history.

(56) References Cited

U.S. PATENT DOCUMENTS 2,095,385 A 10/1937 Heisserman
2,662,641 A 12/1953 Clark
(Continued)

FOREIGN PATENT DOCUMENTS

CN 1895796 A 1/2007
CN 201482560 U 5/2010
(Continued)

OTHER PUBLICATIONS

Notice of Allowance dated Jun. 30, 2015, from JP App. No. 2013-556566, with English Translation.
(Continued)

*Primary Examiner* — Terrell Matthews
(74) *Attorney, Agent, or Firm* — Swanson & Bratschun, L.L.C.

(57) ABSTRACT

The invention relates to a separation-apparatus for separating from a particle-stream at least a first fraction with particles of a first group of dimensions, and a second fraction with particles of a second group of dimensions, comprising an infeed-device for the particle-stream, a rotatable drum having at its circumference plates, each plate having a radially extending hitting surface for the particles, at least a first receiving area proximal to the drum for receipt therein of particles of the first fraction, and at least a second receiving area distant from the drum for receipt therein of particles of the second fraction, wherein the apparatus has a housing so as to protect the particles from outside weather-conditions, allowing that the particles of the particle-stream to be processed by said apparatus have dimensions in the range 0-15 mm.

12 Claims, 1 Drawing Sheet

(51) Int. Cl.

| | |
|---|---|
| ***B07B 13/10*** | (2006.01) |
| ***B07B 13/11*** | (2006.01) |
| ***B07B 13/16*** | (2006.01) |
| ***B07B 4/00*** | (2006.01) |

(56) References Cited

U.S. PATENT DOCUMENTS

| | | | | |
|---|---|---|---|---|
| 2,772,776 | A * | 12/1956 | Myron | B07B 13/003 209/428 |
| 3,356,213 | A | 12/1967 | Weber | |
| 3,430,870 | A | 3/1969 | Weston | |
| 3,757,946 | A * | 9/1973 | Berkowitz | B03B 7/00 209/616 |
| 4,185,746 | A * | 1/1980 | Fegan, Jr. | B07B 13/11 209/691 |
| 4,267,930 | A | 5/1981 | Melkonian | |
| 4,944,868 | A * | 7/1990 | Jay, Sr. | B03B 5/36 134/131 |
| 5,301,816 | A | 4/1994 | Weber | |
| 5,394,991 | A | 3/1995 | Kumagai | |
| 5,860,532 | A | 1/1999 | Arvidson | |
| 5,998,212 | A | 12/1999 | Corio | |
| 6,068,133 | A | 5/2000 | Schonfeld | |
| 6,095,337 | A | 8/2000 | Saveliev | |
| 6,351,676 | B1 | 2/2002 | Thomas | |
| 6,541,725 | B2 * | 4/2003 | Pearson | B07C 5/34 209/590 |
| 6,589,654 | B1 * | 7/2003 | Arcaini | A62D 3/33 106/405 |
| 7,367,457 | B2 | 5/2008 | Warlitz | |
| 7,726,493 | B2 * | 6/2010 | Van Der Weijden | B03B 9/04 209/12.1 |
| 8,392,135 | B2 | 3/2013 | McClain | |
| 8,459,466 | B2 | 6/2013 | Duffy | |
| 8,678,194 | B2 | 3/2014 | Rem | |
| 8,705,031 | B2 | 4/2014 | Sedoglavich | |
| 8,807,344 | B2 | 8/2014 | Keaton | |
| 8,919,566 | B2 | 12/2014 | Golovanevskiy | |
| 8,931,644 | B2 | 1/2015 | Lean | |
| 9,016,478 | B2 | 4/2015 | Bohnlein | |
| 9,033,157 | B2 | 5/2015 | Berkhout | |
| 2003/0000835 | A1 | 1/2003 | Witt | |
| 2004/0040894 | A1 | 3/2004 | Warlitz | |
| 2006/0180522 | A1 | 8/2006 | Legtenberg | |
| 2007/0034554 | A1 | 2/2007 | Van Der Weijden | |
| 2013/0060509 | A1 | 3/2013 | Tsunoda | |
| 2013/0233776 | A1 | 9/2013 | Berkhout | |
| 2014/0238906 | A1 | 8/2014 | Mohanty | |
| 2014/0309782 | A1 | 10/2014 | Sharpe | |

FOREIGN PATENT DOCUMENTS

| | | | |
|---|---|---|---|
| DE | 2436864 | | 2/1976 |
| DE | 2928886 | | 1/1980 |
| DE | 4125236 | | 4/1992 |
| DE | 4223812 | | 8/1993 |
| DE | 4332743 | A1 | 4/1994 |
| DE | 9419448.3 | U1 | 2/1995 |
| DE | 19521415 | | 1/1997 |
| DE | 19649154 | | 3/1998 |
| DE | 19832828 | A1 | 1/2000 |
| DE | 19838170 | | 3/2000 |
| DE | 10056658 | | 7/2002 |
| DE | 102005054811 | | 1/2007 |
| EP | 0550867 | | 12/1992 |
| EP | 1676645 | | 7/2006 |
| ES | 2274434 | | 12/2005 |
| ES | 2352027 | | 2/2011 |
| FR | 2668961 | | 5/1992 |
| GB | 4684 | | 0/1909 |
| JP | S52-165273 | | 12/1977 |
| JP | S59-19576 | A | 2/1984 |
| JP | H07256231 | | 10/1995 |
| JP | 2000-70754 | | 3/2000 |
| JP | 2002-59083 | | 2/2002 |
| JP | 2003-170122 | | 6/2003 |
| JP | 2006-63152 | | 3/2006 |
| JP | 2007-116611 | | 5/2007 |
| JP | 2010-76178 | | 4/2010 |
| JP | 11-221524 | | 4/2011 |
| KR | 10-0585342 | | 10/2004 |
| WO | WO 99/06151 | | 2/1999 |
| WO | WO 00/56472 | | 9/2000 |
| WO | WO 2004/082839 | | 9/2004 |
| WO | WO 2009/123452 | | 10/2009 |

OTHER PUBLICATIONS

Notice_of_Preliminary_Rejection_from_KR039889379_dated_Jun. 15, 2015_in_English.

OA_May 25, 2015_25_from_CN_App_2012800159125_wEnglish_Translation.

Chinese Search Report dated Sep. 28, 2012, from CN 200980115792.4, with English translation.

International Preliminary Report on Patentability dated Aug. 23, 2010 from PCT/NL2009/050165.

International Search Report dated Aug. 15, 2011 from PCT/NL2011/050515.

International Search Report dated Jul. 3, 2009 from PCT/NL2009/050165.

Office Action dated Jan. 13, 2015, from U.S. Appl. No. 13/812,222.

Office Action dated Dec. 31, 2012, from U.S. Appl. No. 12/936,058.

Office Action dated Dec. 31, 2012, Response from U.S. Appl. No. 12/936,058.

Office Action dated Nov. 7, 2013, from U.S. Appl. No. 12/936,058.

Office Action dated Nov. 7, 2013, Response from U.S. Appl. No. 12/936,058.

Office Action dated Aug. 28, 2014, Final from U.S. Appl. No. 12/936,058.

Office Action dated Aug. 28, 2014, Final Response from U.S. Appl. No. 12/936,058.

Office Action dated Apr. 10, 2015, from U.S. Appl. No. 12/936,058.

Office Action dated Apr. 10, 2015, Response from U.S. Appl. No. 12/936,058.

Office Action dated Oct. 19, 2015 from U.S. Appl. No. 12/936,058.

* cited by examiner

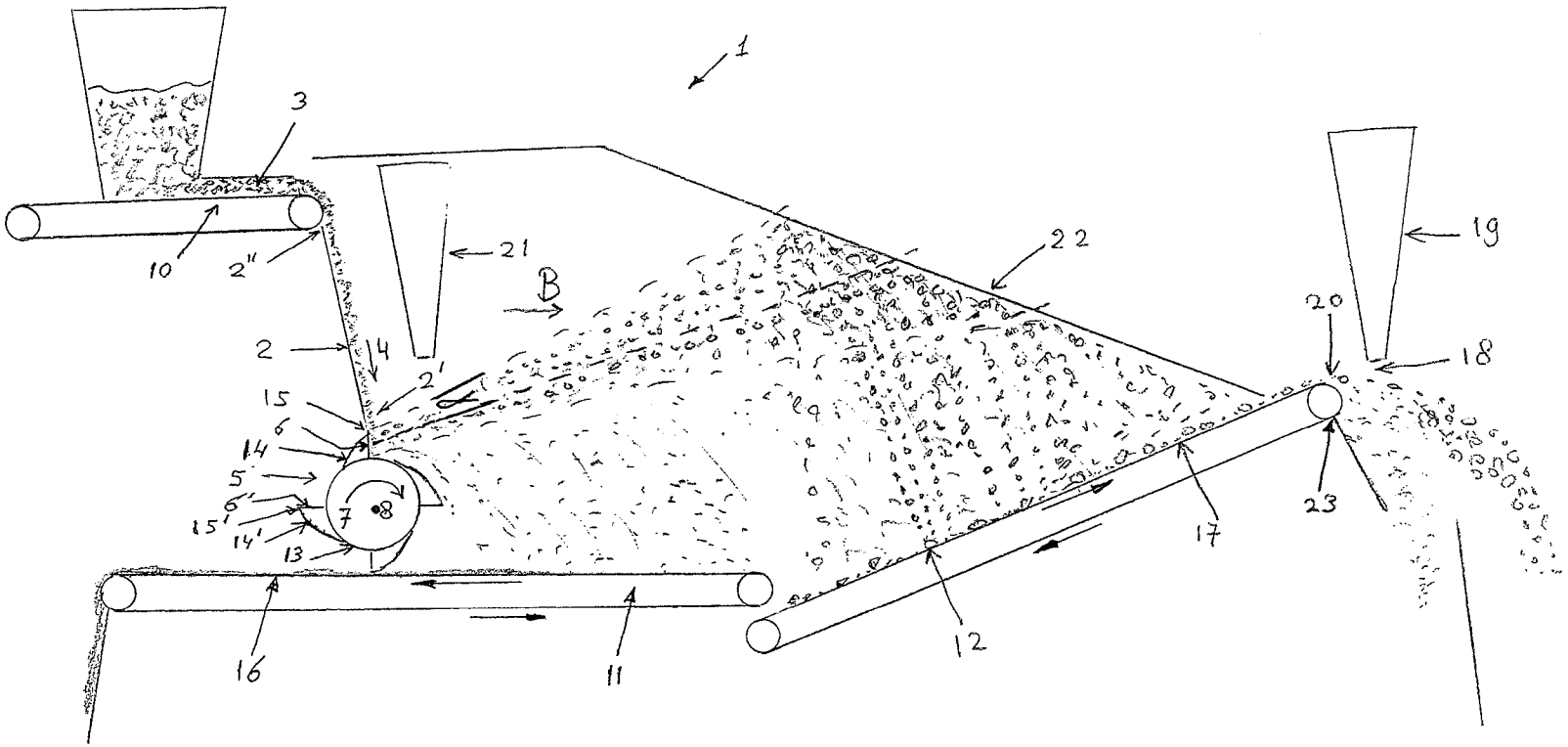
1
3
10
2"
2
14
2'
21
B
22
19
18
20
23
17
12
11
15
6
14
5
6'
15'
14'
13
16
7
8

SEPARATION APPARATUS

RELATED APPLICATIONS

This application is a continuation of U.S. patent application Ser. No. 13/812,222, filed Jan. 25, 2013, entitled "Separation Apparatus", which is a 35 U.S.C. §371 national phase application of PCT/NL2012/050515 (WO 2012/015299), filed on Jul. 15, 2011, entitled "Separation Apparatus", which application claims the benefit of European Application Serial No. 10171151.3, filed Jul. 28, 2010, each of which is incorporated herein by reference in its entirety.

TECHNICAL FIELD

The invention relates to a separation-apparatus for separating from a particle-stream with moist particles at least a first fraction with particles of a first group of dimensions, and a second fraction with particles of a second group of dimensions, wherein the particles in the first group generally are of smaller diameter than the particles in the second group, comprising an infeed-device for the particle-stream, a rotatable drum having at its circumference plates, each plate having a radially extending hitting surface for the particles, and a receiving area for receiving therein the particles of the second fraction, wherein the said receiving area is provided with a conveyor for discharging the particles received in said area.

BACKGROUND

Such an apparatus is known from WO2009/123452 in the name of the applicants. This known apparatus is used for separation of particles of rather small dimensions. The separation of the particles by this known apparatus is achieved by accelerating the moist particles in the particle-stream by the plates of the rotor impinging on said particles during their falling to the rotating drum. This results in a breakup of the particles of the first fraction from the particles of the second fraction that—due to their being moist—initially stick to each other. After their breakup the particles of the first fraction and the particles of the second fraction can freely and individually follow their flight and be collected in different receiving areas. In practice however the separation will not be perfect and the receiving area for the particles of the second fraction will receive also some particles from the first fraction, and the receiving area for the particles of the first fraction will also receive some particles of the second fraction.

The instant invention has as an objective to improve the known separation-apparatus in its function to separate from the particle stream a first fraction and a second fraction, wherein the fractions differ from each other only modestly in terms of the parameters that characterize the particles of said fractions. Like is the case for the known apparatus, this can be explained with reference to bottom-ash of waste incineration plants, although the invention is not restricted thereto.

The November-December 2007 issue of Waste Management World, pages 46-49, elaborates on bottom ash from such waste incineration plants as being by far the largest residue fraction after the incineration process. Due to the conditions of incineration, various materials including metals are comprised in the bottom ash. However, temperatures during the waste incineration process are generally not as high that these materials result in aggregated particles of metals with slag. Instead some 80% of the metals in the ashes are free and suited for re-use. It is said that with a particular type incinerator approximately 50% of the course bottom ashes consist of particles being larger than 2 mm. Conversely, another 50% of the materials is smaller than 2 mm. Particularly, the separation of particles which can be classified as part of a first fraction having dimensions smaller than 2 mm from particles being classified in a fraction having dimensions larger than 2 mm is a good example of the problems that are encountered when their separation is envisaged in a separation apparatus according to the preamble. Since the problems and the objectives that are connected with the separation of said first and second fractions from a particle-stream originating from bottom ash are very illustrative for the invention, the following discussion primarily utilizes the example of processing of bottom ash. It is expressly noted however that the separation-apparatus is not exclusively useable for processing of bottom ash but can be applied to process any type of particles having small dimensions.

On average, in the composition of bottom-ash aggregates of stone, glass and ceramics account for approximately 80% percent of its content and 7 to 18 percent account for ferrous and non-ferrous metals, whereas the remainder generally consists of organic material.

The main non-ferrous metal is aluminium which is present through the entire particle size range of the ash. Other non-ferrous metals are copper, brass, zinc, lead, stainless steel and precious metals which account for large parts of the 1-6 mm fraction or higher up to 15 mm. Such metals that originate from electronic components are largely in the 0-2 mm fraction.

As already mentioned above it is an objective of the invention to provide a separation-apparatus which is particularly suitable for carrying out a separation-method on a particle stream having particles in the ranges just mentioned.

It is a further objective to provide such a separation apparatus and method of its operation, which is applicable to particles that are moist. When the separation-apparatus is to be applied with respect to bottom ash an additional problem is that such bottom ash is relatively wet; it may comprise 15-20 weight % water.

A further objective is to provide a separation-apparatus which renders it possible to regain ferrous and non-ferrous metals of a particle stream with particles having dimensions in the range 0-15 mm.

Still a further objective is to provide such a separation-apparatus in which a first fraction and a second fraction of particles can be separated from a particle stream, wherein the first fraction has particles with a size in the range 0-2 mm and the second fraction has particles with dimensions in the range 2-15 mm.

DE-A-24 36 864 discloses a method in which a ballistic separation is carried out in order to regain thermoplastic particles from domestic waste. DE-A-24 36 864 uses for this purpose an apparatus in accordance with the preamble of the main claim. This known apparatus has a rotor placed in a housing, which rotor has radially extending plates that hit freefalling particles in order to have them follow ballistic trajectories that depend on the particle's specific surface area.

WO2004/082839 discloses a method for the recovery of non-ferrous metal-comprising particles from a particle stream consisting preferably for >90% by weight and more preferably for >98% by weight of particles having a size of <8 mm, yielding a non-ferrous metal-enriched fraction and a non-ferrous metal-depleted fraction, which method comprises the steps of:

a) putting the particle stream onto a conveyor belt in the form of a monolayer such that with the aid of a liquid, at least the non-ferrous metal comprising particles will adhere to the conveyor belt;

b) subjecting the moist mono-layer on the conveyor belt to a magnetic field rotating in the same direction as the belt, for the separation of non-ferrous metal-comprising particles, yielding the non-ferrous-enriched fraction, and c) removing the particles adhering to the conveyor belt, yielding the non-ferrous metal-depleted fraction.

The liquid content of the particle stream on the conveyor belt is, for example, ≥5%, such as ≥10%, and advantageously ≥12%, in relation to the total weight of the particle stream on the conveyor belt. In an example pertaining to the separation of nonferrous metals from bottom ash, a sifting operation resulted into a 50μ-2 mm fraction and a 2-6 mm fraction, whereafter the 2-6 mm fraction was subjected to a treatment with a rotary drum eddy-current separator.

EP-A-1 676 645 discloses an apparatus and method to sort a stream of mingled paper and plastic items. The items are fed by a conveyor to a release area spaced above a hitting area to which the items are falling, and from where the items are hit by hitting blades that are moved through the hitting area in a direction that diverges from the falling direction of the items. The items are collected in several receiving windows remote from the hitting area, each window corresponding to one of several fractions of the original stream of paper and plastic items.

DE-A-43 32 743 discloses a separation apparatus that is placed in a housing.

SUMMARY OF THE EMBODIMENTS

The separation apparatus of the invention is embodied with the features of one or more of the appended claims. It is expressly pointed out that the subject-matter mentioned in the characterizing portion of claim 6 and/or claim 7 and the claims depending on claim 7, may be applied separate and independent from the subject-matter mentioned in the characterizing portion of claim 1, provided that with respect to claim 7 at least a conveyor is placed in the receiving area for the second fraction.

In a first aspect of the invention the separation apparatus according to the preamble has the conveyor in the receiving area for the particles of the second fraction equipped to move during use at a speed of at least 2 m/s. This secures that the particles received on said conveyor are distributed over an extended moving surface area of the conveyor, and as a result the particles cover only part of the surface area of the conveyor which might be considered to constitute a monolayer distribution on said conveyor. This sparse distribution on the conveyor is very effective in preventing that particles of the first fraction which unintentionally arrive on the conveyor come to stick again against particles of the second fraction, which would deteriorate the effectivity of the separation process.

A further advantage of the mentioned high moving speed of the conveyor of at least 2 m/s is that, at the end of the conveyor, the particles of the second fraction which are heavier than the particles of the first fraction, are catapulted to a location distant from the conveyor whereas the particles of the first fraction simply fall off the conveyor or stick to it. This therefore contributes tremendously to the separation efficiency.

It has been found that best results are achieved when the surface of the conveyor moves at a speed of 4 m/s.

The separation efficiency between the lighter particles of the first fraction and the heavier particles of the second fraction can be promoted by arranging that said fast-moving conveyor in the receiving area for the second fraction has an inclined position such that it moves the particles deposited thereon upwards to the conveyor's outlet.

Desirably at the conveyor's outlet a scraper is provided for removal of particles of the first fraction that stick to the surface of the conveyor. This material of the first fraction that is scraped off the surface of the conveyor is of course preferably separately collected from the material that is catapulted away from the conveyor and which is collected distant from the conveyor's outlet.

It is possible to embody the separation apparatus at the conveyor's outlet with a first blower that supplies a downwardly directed air-flow for removal of those particles of the first fraction that are catapulted from the conveyor together with the particles of the second fraction. The application of such a blower is known per se from WO2009/123452. The inventors have found that the air flow supplied by the first blower is most effective when it has an airflow speed in the range 15-30 m/s.

It is possible to realize the separation apparatus of the invention in accordance with WO2009/123452 by arranging the infeed-device with a vibrating slide plate inclined at an angle in the range 70-90° with respect to the horizon and having an edge positioned above the drum, which edge is embodied as an outlet for the particle-stream, and in that the edge of the vibrating plate is positioned vertically above an axis of rotation of said drum so as to cause that in use the particles of the particle-stream fall towards the drum in a direction aimed towards said axis of rotation, and to arrange that the plates of the drum impinge on said falling particles at a moment that said plates are in an approximately vertically upwards oriented position extending from the drum.

Both the plate being vibrating and its inclination at an angle in the range 70 to 90° are measures that are taken to prevent that the particle stream that is leaving the infeed device and is moving towards the drum, starts clogging together and stick to the slide plate. If this happens the intended accurate separation of the particles into a first relatively light fraction and the second relatively heavy fraction is no longer achieved. As a further aspect of the invention the inventors have found that preventing the clogging of the particle material is effectively secured only when the slide plate is inclined at an angle of approximately 85°. The flow of particles then has properties similar to those of a monolayer flow of material.

In a still further aspect of the invention the separation apparatus may be provided with a second blower providing a downwardly directed airflow, which blower is placed in the vicinity of the drum for early removal to a second receiving area of particles of the first fraction from the stream of particles that move away from the drum after the plates of the drum, at the moment that said plates are in an approximately vertically upwards oriented position extending from the drum, have impinged on said particles falling along the slide plate of the infeed device towards the drum. This second blower may also be applied with the same effect if the conveyor in the second receiving area as mentioned in claim 1 is omitted.

Yet another aspect of the invention which may be applied independent from the other features discussed above is that, distant from the drum and downwardly inclined in a direction pointing away from the drum, a collision plate is placed which extends at least in part above the conveyor in the second receiving area.

This collision plate serves to provide a controlled movement of the stream of particles towards the conveyor in the receiving area for the second fraction. It has been found that the angle of inclination of the collision plate has an effect on its sensitivity to pollute with particles of the first fraction.

In connection therewith it is preferred that the collision plate is inclined at an angle of less than 45° with respect to the horizon. At this angle it is found that the particles of the second fraction that continuously bombard the collision plate, constantly remove the particles of the first fraction that come to stick to the collision plate. In this respect best results appear to be achievable when the collision plate is inclined at an angle of between 15° and 30° with respect to the horizon.

It has been demonstrated that the first fraction pertaining to particles having smaller dimensions, preferably in the range 0-2 mm, do not travel as far from the drum as do the particles from the second fraction pertaining to particles having relatively larger dimensions, preferably in the range 2-15 mm. The separation-apparatus of the invention is thus very suited for use as a classifying means for the particles of the particle stream, and when the particle stream originates from waste-incineration ashes the separation-apparatus can beneficially be used to concentrate metals from said ashes into the second fraction. It is then preferred that the second fraction be further processed in a dry separation method to separate the metals from this fraction further into ferrous and non-ferrous metals. This is due to the circumstance that during processing of the particle stream in the separation-apparatus of the invention it has been shown that the second fraction has already lost much of the fines and its water content.

The invention will hereinafter be further elucidated with reference to an exemplary schematic embodiment of the separation-apparatus of the invention and with reference to the drawing.

BRIEF DESCRIPTION OF THE DRAWINGS

In the drawing a single FIG. 1 shows schematically the separation-apparatus of the invention.

DETAILED DESCRIPTION

With reference to FIG. 1 the separation-apparatus of the invention is generally denoted with reference numeral 1. This separation-apparatus 1 is used for separating particles 3 of a first fraction and of a second fraction wherein the respective fractions pertain to particles having different dimensions.

The particles 3 are collectively supported by an infeed-device 2, 10. The infeed-device comprises a conveyor 10 followed by a slide plate 2 which is arranged to be vibrating causing that the particles 3 leave the slide plate 2 over the edge 2' in a particle stream as symbolised by the arrow 4. Prior to leaving the slide plate 2 at its edge 2' the particle stream 4 is supported by said slide plate 2. This slide plate 2 is downwardly sloping in order to support the development of a monolayer-type flow of said particle stream 4 with a thickness measured from the surface of plate of two to three times, and at most four times the maximum particle diameter.

The edge 2' of the vibrating plate 2 is positioned above a drum 5, which can rotate around its axis 8 of rotation and which drum 5 has at its circumference 13, plates 6, 6'. Each plate 6, 6' has a radially extending hitting surface for impinging on the particles 3 that arrive in the vicinity of the drum 5.

As already mentioned it is preferred to apply a slide plate 2 that slightly tilts downwards as seen from the transitional area 2" between the conveyor 10 and the slide plate 2. This tilting downwards is preferably 85° degrees with respect to the horizon.

As FIG. 1 clearly shows the edge 2' of the vibrating slide plate 2 is positioned vertically or near vertically above the axis 8 of rotation of the drum 5 so as to cause that in use the particles 3 of the particle stream 4 fall towards the drum 5 in a direction aimed towards said axis 8 of rotation or to its immediate vicinity. This construction further arranges that the plates 6, 6' of the drum 5 impinge on said falling particles 3 at a moment that said plates 6, 6' are in a vertically or near vertically upwards oriented position extending from the drum 5. This is shown in FIG. 1 with respect to plate 6.

The plates 6, 6' are further provided with a backing 14 that slopes from the free extremities 15, 15' of said plates 6, 6' towards the drum's circumference 13. This way turbulence behind the plates 6, 6' is effectively avoided during rotation of the drum 5.

In use the drum 5 is caused to rotate at a speed such that the plates 6, 6' impinge on the particles 3 in the particle stream 4 with a horizontal speed in the range 10-30 m/s. Due to this action FIG. 1 shows that a cloud of particles moves in the direction of arrow B to be collected in at least a receiving area 11 proximal to the drum 5 for receipt therein of the smaller particles of the first fraction, and another receiving area 12 for receipt therein of the larger particles of the second fraction.

With a proper tuning of the vibrating of slide plate 2 in terms of vibrating frequency and vibrating amplitude and by a proper selection of the rotational speed of the drum 5 it is possible to realise an effective separation of the particles into a first and into a second fraction, wherein the first fraction pertains to particles having dimensions in the range 0-2 mm and the second fraction pertains to particles having dimensions in the range 2-15 mm. A proper operation of the apparatus of the invention can be identified when the particles leave the drum 5 in a manner that their angle of departure $\alpha$ does not differ more than 12 degrees from the mean angle of departure of the stream as a whole.

The separation apparatus 1 may further be provided with a housing (not shown) in order to protect the particles 3 from outside weather conditions, thus allowing that the particles 3 of the particle stream 4 have dimensions in the range 0-15 mm can at all be processed in the apparatus of the invention.

Both the receiving area 11 for the first fraction and the receiving area 12 for the second fraction are in practice each provided with a conveyor belt 16, 17 for removing the collected particles from said areas. The conveyor belt 16 in the receiving area 11 for the first light fraction is not mandatory, and can be replaced for instance by a collecting bin. According to the invention it is required however to apply in the receiving area 12 for the heavy second fraction a conveyor 17. On this conveyor 17 predominantly the particles of the heavier second fraction are collected, but unavoidably also some particles of the lighter first fraction may arrive on that conveyor 17.

All particles 3 that are collected on the conveyor 17 are discharged from the receiving area 12 and transported by the conveyor 17 operating at a conveying speed that is at least 2 m/s, and preferably 4 m/s, which is high enough to cause that the particles will be sparsely distributed on the moving surface area of the conveyor 17, which prevents that the particles of the first fraction and the particles of the second fraction will stick together again. Preferably the conveyor 17 is inclined such that it moves the particles deposited thereon upwards to the conveyor's outlet. This promotes that the high-speed of the conveyor 17 causes the heavier particles 3 of the second fraction to leave the conveyor belt 17 with a speed sufficient for the particles of the second fraction to travel through an essentially transversal air-flow 18 originating from a blower 19. Due to the air-flow 18 any particles of the first lighter fraction that are captured by or dragged along with the larger particles 3 of the second fraction are released therefrom. The air-flow 18 can easily be arranged by application of a blower 19 providing a downwardly directed airstream 18 immediately adjacent to the exit point or outlet 20 where the particles 3 leave the conveyor belt 17. A proper value for the flow of the airstream 18 is in the range 15-30 m/s.

As shown in FIG. 1 at the conveyor's outlet a scraper 23 is provided for removal of particles of the first fraction that tend to stick to the surface of the conveyor 17.

FIG. 1 further shows that a second blower 21 may be applied that provides a downwardly directed airflow, and which blower 21 is placed in the vicinity of the drum 5 for early removal towards the receiving area 11 of the particles of the first fraction from the stream of particles that moves away from the drum 5 after the plates 6, 6' of the drum 5, at the moment that said plates 6, 6' are in a vertically upwards oriented position extending from the drum 5, have impinged on said particles 3 falling along the slide plate 2 of the infeed device 2, 10 towards the drum 5.

A further feature of the invention is that distant from the drum 5 and downwardly inclined in a direction pointing away from the drum 5 is a collision plate 22 which extends at least in part above the conveyor 17 in the receiving area 12 for the second heavier fraction.

The collision plate 22 is inclined at an angle of less than 45° with respect to the horizon, preferably the collision plate 22 is inclined at an angle between 15° and 30° with respect to the horizon.

Results

The recovery results when applying the separation apparatus of the invention for the separation and recovery of a sample of 750 kg of bottom ash having particles in the range of 0-15 mm, are as follows:

| Input | Recovery Coarse product | Recovery Fine product |
|---|---|---|
| 4 mm-15 mm | 96.5% | 3.5% |
| 2 mm-4 mm | 96.6% | 3.4% |
| 1 mm-2 mm | 79.9% | 20.1% |
| 0.5-1 mm | 52.0% | 48.0% |
| 0.25-0.5 mm | 42.4% | 57.6% |
| 0.125-0.25 mm | 44.8% | 55.2% |
| 0.063-0.125 mm | 50.5% | 49.5% |
| 0.038-0.063 mm | 67.7% | 32.3% |

From these results it is clear that the separation apparatus of the invention is very effective for the recovery of particles of a second fraction in the range 2-15 millimeters, from particles of a first fraction being sized below 2 mm.

The inventors expressly point out that the exemplary embodiment as discussed hereinabove relates to the operation and construction of the separation-apparatus of the invention without necessarily being restricted to the processing of waste-incineration ashes or bottom ashes. The separation apparatus of the invention is generally applicable to any type of particle that is required to be classified into fractions of particles having dimensions in the lower ranges such as 0-15 mm without being restricted to such particles as are derived from waste incineration plants.

What is claimed is:

1. A separation-apparatus for separating from a particle-stream at least a first fraction with particles of a first group of dimensions, and a second fraction with particles of a second group of dimensions, wherein the particles in the first group generally are of smaller diameter than the particles in the second group, comprising:

an infeed-device for the particle-stream:

a rotatable drum having at its outer circumference plates attached to the rotatable drum to rotate therewith, each plate having a radially extending hitting surface for the particles;

a collision plate distant from the drum and downwardly inclined in a direction pointing away from the drum extending at least in part above a receiving area for the second fraction; and a receiving area for receipt of the particles of the second fraction, wherein the said receiving area is provided with a conveyor for discharging the particles received in said receiving area, wherein the conveyor in the receiving area for the second fraction is configured to move during use at a speed of at least 2 m/s.

2. The separation apparatus according to claim 1, further comprising the conveyor in the receiving area for the second fraction having an inclined position such that it moves the particles deposited thereon upwards to a conveyor outlet.

3. The separation apparatus according to claim 1, characterized in that the surface of the conveyor moves at a speed of 4 m/s.

4. The separation apparatus according to claim 1, further comprising a scraper at an outlet of the conveyor for removal of particles of the first fraction that stick to the surface of the conveyor.

5. The separation apparatus according to claim 1, further comprising a first blower at an outlet of the conveyor, the first blower being configured to supply a downwardly directed airflow for removal of particles of the first fraction that are dragged along by particles of the second fraction, wherein the airflow supplied by the first blower has an airflow speed in the range 15-30 m/s.

6. The separation apparatus according to claim 1, wherein the infeed-device comprises a vibrating slide plate that is inclined at an angle in the range 70-90° with respect to the horizon, which slide plate has an edge positioned above the drum, which edge is embodied as an outlet for the particle-stream, and in that the edge of the vibrating slide plate is positioned vertically above an axis of rotation of said drum so as to cause that in use the particles of the particle-stream fall towards the drum in a direction aimed towards said axis of rotation, and to arrange that the plates of the drum impinge on said falling particles at a moment that said plates are in an approximately vertically upwards oriented position extending from the drum.

7. The separation apparatus according to claim 6, further comprising a second blower providing a downwardly directed airflow in the vicinity of the drum for early removal to a second receiving area of particles of the first fraction from the stream of particles that move away from the drum after the plates of the drum, at the moment that said plates are in an approximately vertically upwards oriented position extending from the drum, have impinged on said particles falling along the slide plate of the infeed device towards the drum.

8. The separation apparatus according to claim 1, wherein the collision plate is inclined at an angle of less than 45° with respect to the horizon.

9. The separation apparatus according to claim 1, wherein the collision plate is inclined at an angle between 15° and 30° with respect to the horizon.

10. A method of separating of a moist particle-stream into at least a first fraction with particles of a first group of dimensions, and a second fraction with particles of a second group of dimensions, wherein the particles in the first group generally are of a smaller diameter than the particles of the second group, the method comprising:

providing a moist particle stream in a substantially vertical free-flow;

striking the moist particle stream with a substantially vertically oriented plate extending from an outer circumference of a rotating drum and attached to the rotating drum to rotate therewith to impart a sudden change in the particle stream from a substantially vertical to a substantially horizontal flow, thereby separating a first quantity of the first fraction of particles from a first remainder comprising the second fraction of particles and particles of the first fraction of particles bound the second fraction of particles;

colliding the first remainder off a collision plate distant from the vertically oriented plate, the collision plate being downwardly inclined in a direction pointing away from the vertically oriented plate thereby separating a second quantity of the first fraction of particles from a second remainder comprising the second fraction of particles and particles of the first fraction of particles bound the second fraction of particles, the collision plate extending at least in part above a receiving area for the second remainder;

accelerating the second remainder of particles received in said receiving area to a speed of at least 2 m/s on an upward inclined conveyer; and discharging the particles at a conveyor outlet, thereby separating a third quantity of the first fraction of particles from a third remainder comprising substantially only the second fraction of particles.

11. The method of claim 10 further comprising supplying a downwardly directed airflow at the conveyor outlet for removal of any particles of the first fraction of particles that are included in the third remainder, wherein the airflow supplied by the first blower has an airflow speed in the range 15-30 m/s.

12. The method of claim 10 further comprising providing a downwardly directed airflow in the vicinity of the vertically oriented plate for early removal to a second receiving area of particles of the first fraction from the stream of particles that move away from the vertically oriented plate.

* * * * *